US005950838A

United States Patent [19]

Fletcher et al.

[11] Patent Number: 5,950,838

[45] Date of Patent: Sep. 14, 1999

[54] FOIL PAN PACKAGING

[75] Inventors: Carl R. Fletcher, Kildeer; Norton Sarnoff, Northbrook, both of Ill.

[73] Assignee: Handi-Foil Corporation, Wheeling, Ill.

[21] Appl. No.: 09/004,381

[22] Filed: Jan. 8, 1998

[51] Int. Cl.[6] ..... B65D 25/00

[52] U.S. Cl. ..... 206/775; 206/499

[58] Field of Search ..... 206/736, 738, 206/756, 757, 775, 499, 557

[56] References Cited

U.S. PATENT DOCUMENTS

| | | | |
|---|---|---|---|
| 1,345,949 | 7/1920 | Myers . | |
| 2,032,351 | 3/1936 | Chaplin . | |
| 2,691,337 | 10/1954 | Forrest . | |
| 2,829,057 | 4/1958 | Voelker . | |
| 2,873,023 | 2/1959 | Erickson . | |
| 3,190,758 | 6/1965 | Hauf . | |
| 3,339,725 | 9/1967 | Hamilton . | |
| 3,379,536 | 4/1968 | Foss et al. . | |
| 3,414,183 | 12/1968 | Wilcox . | |
| 3,912,118 | 10/1975 | Bird . | |
| 4,007,285 | 2/1977 | Maier et al. . | |
| 4,141,448 | 2/1979 | Mascia et al. . | |
| 4,308,952 | 1/1982 | Paulucci . | |
| 4,435,434 | 3/1984 | Caporaso | 206/499 X |
| 4,817,801 | 4/1989 | Schwaikert | 206/499 X |
| 4,874,083 | 10/1989 | Antoni et al. . | |
| 5,123,527 | 6/1992 | Hustad . | |
| 5,220,999 | 6/1993 | Goulette . | |

OTHER PUBLICATIONS

Advertisement for "EZ Foil Advantage System".

*Primary Examiner*—Jacob K. Ackun

[57] ABSTRACT

A tray and method for packaging foil pans having outwardly-extending flange portions. The tray surrounds the outer bottom and side surfaces of the packaged foil pans, protecting the foil pans from damage. The tray includes an engagement portion with a lower surface and an inward protrusion, whereby the outwardly-extending flange portions of the packaged foil pans are securely held therebetween. An integral hang tab extends outwardly from the packaging tray to enable the tray with packaged foil pans to be hung from a display rack. Trays with packaged foil pans may be nested together in either a horizontal orientation or a vertical orientation. Foil pans may be snap-locked into the tray by pressing the outwardly-extending flange portions against the inward protrusion, which flexes allowing the foil pans to pass by and then snaps back to retain the foil pans within the tray.

10 Claims, 3 Drawing Sheets

FOIL PAN PACKAGING

BACKGROUND OF THE INVENTION

1. Field of the Invention

The present invention relates to the art of packaging foil pans and similar items. More particularly, the present invention is directed to a tray for packaging foil pans and a method of inserting foil pans into the tray to form a packaged assembly.

2. Description of Related Art

Foil pans are typically displayed in stores and sold to consumers as part of a packaged assembly. Such foil pans may be round, square, or oval and are made out of aluminum foil typically having a thickness of from about 30 to 45 gauge. The packaged assembly generally includes a plurality of foil pans, nested together, and packaging to hold the foil pans together. Labels are also often provided, placed either on the packaging or on the foil pans themselves. The packaged assembly may be displayed in the store resting on a shelf in a horizontal orientation. However, the packaging may also include means for hanging the packaged assembly so that it may be displayed in a vertical orientation, such as hanging from a display rack.

A number of such packaging structures and methods are known. In one approach, a band made out of a heat-shrinkable plastic is placed around the outwardly-extending flange portions of the nested foil pans. Upon the application of heat, the plastic shrinks so as to fit snugly about the top and bottom of the flanges, thereby holding the foil pans together. A disadvantage of this method is that, because of their thin gauge nature, foil pans are easily dented, scratched, bent, crushed, or otherwise damaged during the handling that occurs before sale to the consumer. Particularly vulnerable is the outer surface of the assembly of nested foil pans, namely, the bottommost foil pan, which is susceptible to surface marring during shipment or display. Because the plastic band only covers the flange portions of the foil pans, the bottom and sides of the bottom foil pan in the packaged assembly remain exposed and are therefore subject to such damage. Another disadvantage of this method is that the heat shrink plastic band does not provide a good way to attach a hang tab to allow the foil pans to be hung for display.

Another approach is to use "blister" packaging, which typically consists of a top half and a bottom half, both halves being made out of a clear plastic. The nested foil pans are held between the two halves, which are then joined by heat-sealing, taping, stapling, or similar methods. Because the packaging completely surrounds the foil pans, the foil pans are protected to some degree from damage. A hang tab may also be conveniently provided on the "blister" packaging. However, "blister" packaging has the disadvantage of requiring more material and a complex packaging process in that the two halves must be mated together. Another disadvantage is that, because the packaging completely surrounds the foil pans, the consumer is not able to touch and feel any portion of the surface of the foil pans. Such direct and tactile observation of the foil pans is important in bolstering consumer confidence with the product and thus serves to enhance marketability.

Goulette U.S. Pat. No. 5,220,999 discloses a nestable container comprising a base and a hinged lid that may be used to package articles such as foil pans. The container is closed by means of a tongue disposed on the lid which engages a mating projection disposed on the base. A hang tab is also provided on the lid. When the lid is closed, the container completely surrounds the packaged articles. Preferably, the container is made out of a clear plastic so that the consumer is able to see the packaged articles. However, the consumer is unable to touch the packaged articles without opening the container. This presents a significant inconvenience to the consumer, particularly if the container is hung from a display rack. Indeed, if the container is opened while it is hung, either intentionally or by accident, the articles can easily fall out. Another disadvantage of this container is the complexity of its design.

Foss, et al. U.S. Pat. No. 3,379,536 discloses a pie crust package. A plurality of nested pie crust filled pie pans are held together in assembled relation by means of a clear plastic member dish-shaped to conform to the shape of the uppermost pie pan. The plastic member covers the top of the uppermost pie pan and has a downwardly depending flange with circular grooves to engage the peripheral edges of the pie pans. In this way, each packaged pie pan is held in a circular groove. A disadvantage of this design when used with foil pans is that, although the top most foil pan would be covered, the more vulnerable bottommost foil pan would remain exposed and thus subject to damage. Another disadvantage is that no hang tab is provided in the Foss assembly, so that no means are provided for display in a vertical orientation. The lack of a hang tab further means that no fixed reference point is provided to ensure that a label affixed to a Foss assembly displayed for retail will be in the proper orientation for reading or even that the labels on nested assemblies will all be in the same orientation.

SUMMARY OF THE INVENTION

The principal object of the present invention is to provide a tray for packaging a plurality of nested foil pans that has a simple design and that allows for a simple and efficient packaging process.

Another object of the present invention is to provide a tray which protects the packaged foil pans from damage while still allowing consumers to touch the product.

Still another object of the present invention is to enable the packaged assembly to be displayed vertically by being hung from a display rack.

Yet another object of the present invention is to provide a packaged assembly that is nestable when it is displayed either horizontally or vertically.

A related object of the present invention is to provide a packaged assembly having a fixed reference point for affixing labeling that will be in the proper orientation for reading when the packaged assembly is displayed either horizontally or vertically.

A further object of the present invention is to provide a method of inserting foil pans into the packaging tray to form a packaged assembly.

In accordance with the present invention, a tray for packaging foil pans is provided. The tray has a bottom portion, a side portion, and an engagement portion. The tray surrounds the outer bottom and side surfaces of the packaged foil pans to protect the foil pans from damage but is open at the top so that the consumer is still able to feel a portion of the surface of the foil pans. The engagement portion includes a lower surface and an inward protrusion, whereby the outwardly-extending flange portions of the packaged foil pans are securely held therebetween. The bottom and side portions of the tray substantially conform to the dimension and shape of the bottom and sides of the foil pans, so that similar packaged assemblies may be nested together.

An integral hang tab extends outwardly from the packaging tray to allow the packaged assembly to be hung from display racks and the like. Because the location of the hang tab is fixed with respect to the rest of the tray and with respect to the foil pans held within the tray, when packaged assemblies are nested together their respective hang tabs are all in alignment. In this way, packaged assemblies nested together may be displayed in either a horizontal orientation, such as resting on a shelf, or they may be hung nested together in a vertical orientation. The hang tab also provides a fixed reference point to ensure that labels are affixed to the packaged assembly in the correct orientation for reading. In this way, the lettering and other indicia on the labels is readable when nested packaged assemblies are hung from their hang tabs in a vertical orientation or when nested packaged assemblies are placed in a horizontal orientation with all hang tabs aligned.

A foil pan is inserted into the packaging tray by first orienting the bottom of the foil pan in the direction of the tray and then pressing the outwardly-extending flange portion of the foil pan against the inward protrusion. The inward protrusion flexes, allowing the flange portion to pass by, and then snaps back so as to retain the foil pan within the packaging tray. When a sufficient number of foil pans have been inserted into the tray so that the flanges fill the entire space between the lower surface and the inward protrusion, the foil pans are securely held in place, and the packaging operation is complete. In addition, more than one foil pan may be inserted in this way at a time.

DESCRIPTION OF THE PREFERRED EMBODIMENTS

Figure 1:
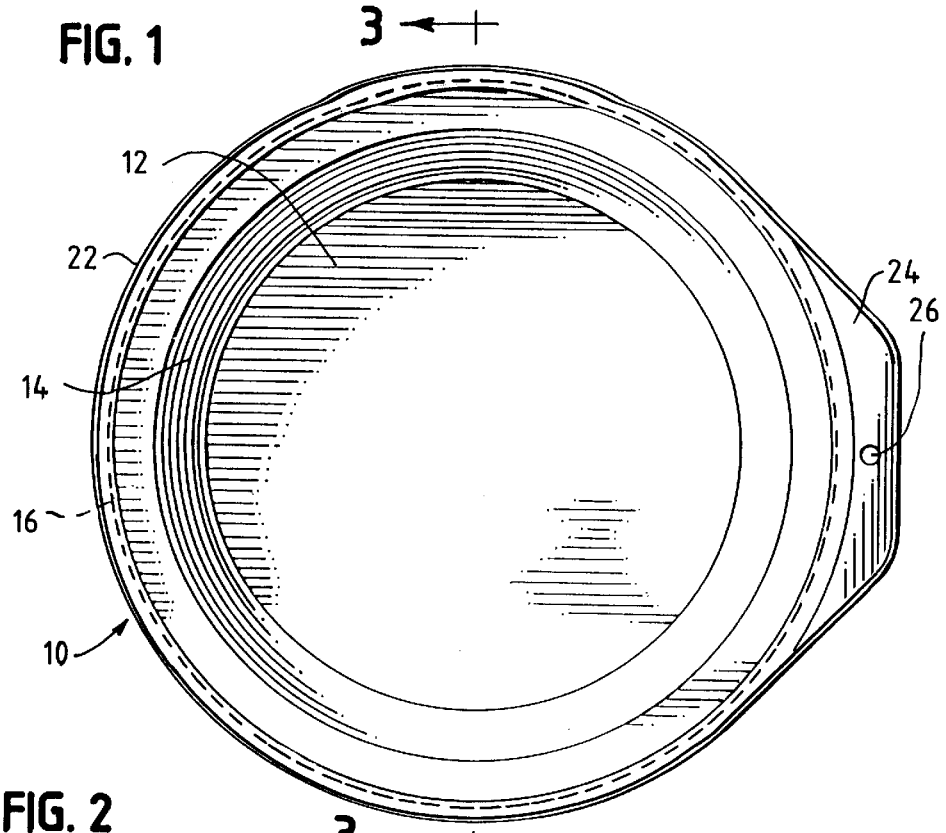
FIG. 1 is a top view of a preferred embodiment of a tray for packaging round foil pans in accordance with the present invention.
Figure 2:
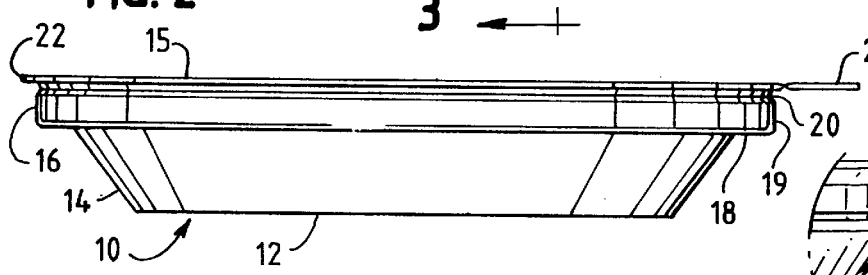
FIG. 2 is a side view of the FIG. 1 embodiment of a tray for packaging round foil pans in accordance with the present invention.
Figure 3A:
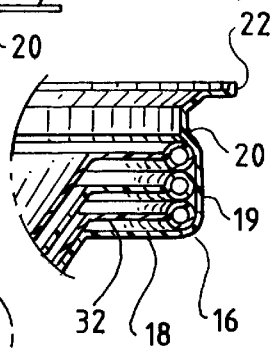
FIG. 3A is an enlarged view of the upper portion of the cross-sectional side view of FIG. 3.

With reference to FIGS. 1 and 2, a preferred embodiment of a tray 10 for packaging round foil pans is shown. Tray 10 has a bottom portion 12, a side portion 14, and an open top 15. Side portion 14 is connected at one end to bottom portion 12, and at the other end an engagement portion 16 is formed. With reference to FIG. 3A, engagement portion 16 includes a lower surface 18, which extends outwardly from side portion 14. Extending upwardly from lower surface 18 is a vertical wall 19. Extending upwardly from vertical wall 19 is an inward protrusion 20. Extending upwardly from inward protrusion 20 is an outer lip 22.

Tray 10 is preferably made out of a thin gauge transparent and resilient plastic. Most preferably, tray 10 is made out of biaxially oriented polystyrene (OPS) having a thickness in the range of about 6 mils to about 10 mils.

Figure 3:
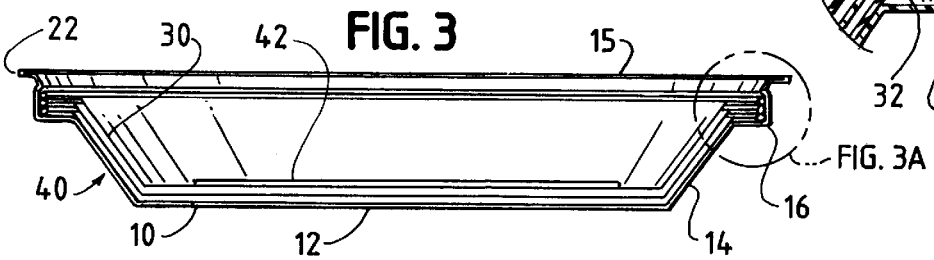
FIG. 3 is a cross-sectional side view of the FIG. 1 embodiment of a tray for packaging round foil pans, with three round foil pans inserted therein, taken substantially along the plane of section line 3—3 of FIG. 1.
Figure 3B:
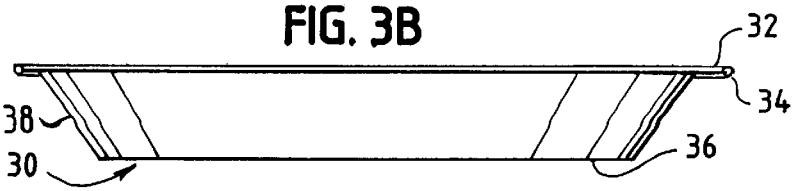
FIG. 3B is a cross-sectional view of one of the round foil pans packaged in FIG. 3.

With reference to FIG. 3, tray 10 is shown in a cross-sectional side view with three round foil pans 30 nested together and packaged therein. With reference to FIG. 3B, each foil pan 30 has an outwardly-extending flange portion 32 ending in a circumferential rim 34, as well as a bottom 36 and a side 38. The distance from rim 34 on one side of foil pan 30 to rim 34 on the opposite side of foil pan 30 defines the rim width of the foil pan 30. Although three round foil pans 30 are shown, tray 10 may be shaped such that a greater or lesser number of foil pans may be packaged by tray 10. The combination of tray 10 together with the foil pans 30 comprises a packaged assembly 40.

Side portion 14 and bottom portion 12 of tray 10 surround the sides 38 and bottoms 36 of the packaged foil pans 30, thereby shielding foil pans 30 from scratching, denting, marring, or other such damage caused by impacts. Moreover, the rigidity of tray 10 reduces the chances of the packaged foil pans 30 from becoming bent, twisted, or otherwise deformed during handling. However, because tray 10 includes open top 15, the inner surface of the topmost foil pan 30 may be observed and touched by the consumer. Preferably, the shape and dimensions of side portion 14 and bottom portion 12 of tray 10 are made to substantially conform to the shape and dimensions of side 38 and bottom 36, respectively, of the foil pans 30 so that packaged assemblies 40 may be nested together.

FIG. 3A shows in detail the interaction of engagement portion 16 with the outwardly-extending flange portions 32 of foil pans 30. Lower edge 18 is sized to correspond to the size of the outwardly extending flange portion 32 of foil pan 30, and the width defined by inward protrusion 20 about the open top 15 of tray 10 is sized to correspond to the rim width of foil pans 30. The height of vertical wall 19 is likewise sized to correspond to the height of the stacked and nested outwardly-extending flange portions 32 of the number of foil pans 30 to be packaged. In the packaged assembly 40 the flange portions 32 are securely held between inward protrusion 20 and lower surface 18.

With tray 10 formed from OPS or similar material, engagement portion 16 has sufficient flexibility to allow the outwardly extending flange portions 32 of foil pans 30 to be "snap-locked" into place under the inward protrusion 20, and similarly to allow said foil pans to be removed from said tray on demand, yet also to have sufficient rigidity to allow said foil pans to remain packaged in said tray during normal shipping and handling movements. In particular, to insert foil pan 30 into tray 10, foil pan 30 is first properly oriented so that bottom 36 is directed toward the open top 15 of tray 10. Flange portion 32 is pressed against inward protrusion 20, which then flexes outwardly allowing flange portion 32 to pass by it. Once flange portion 32 passes inward protrusion 20, inward protrusion 20 snaps back to its original position, thereby retaining foil pan 30 within tray 10.

When a sufficient number of foil pans 30 have been inserted into tray 10, such that flange portions 32 take up all of the distance between inward protrusion 20 and lower surface 18, foil pans 30 are securely held in place and the packaging operation is complete. More than one foil pan 30 may be inserted at a time in the manner described above. Preferably, all of the foil pans 30 intended to be packaged are inserted into tray 10 at once.

With reference to FIG. 3B, outer lip 22 provides a means by which the foil pans 30 may be quickly and easily removed from tray 10. By applying pressure on outer lip 22, the user can flex the engagement portion 16 outwardly so that inward protrusion 20 no longer engages a portion of flanges 32 of foil pans 30. In this way, one or more foil pans 30 may be released from engagement portion 16 and removed from tray 10.

As shown in FIGS. 1 and 2, tray 10 is preferably made with an integral hang tab 24. Hang tab 24 is shaped to allow tray 10 with foil pans 30 packaged within to be hung from display rack in a vertical orientation. Hang tab 24 preferably includes a hole 26 able to receive a hook, bar, or the like disposed on a display rack. Hang tab 24 may also be hook-shaped to engage such a hook or bar on a display rack. Hang tab 24 may be formed into other shapes to accommodate the particular display requirements. Because hang tab 24 is integral to tray 10 and the packaged foil pans 30 are held firmly within tray 10, the locations of hang tab 24 and hole 26 maintain a fixed relationship with respect to tray 10 and packaged foil pans 30. The registry of the hang tab 24 with respect to the rest of tray 10 and the packaged foil pans 30 ensures that when a plurality of packaged assemblies 40 are nested together, the holes 26 can all be aligned so that the nested packaged assemblies 40 may all be hung together from the same hook, bar, or the like for display in a vertical orientation.

Typically, a label 42 is affixed to the uppermost one of the packaged foil pans 30 of packaged assembly 40, as shown in FIG. 3, for display to consumers. The fixed location of hang tab 24 with respect to the packaged foil pans 30 provides a reference point for the proper orientation of label 42. The proper orientation of label 42 is one where the lettering or other indicia (not shown) on label 42 are readable when packaged assembly 40 is displayed either vertically or horizontally. For example, when nested packaged assemblies 40 are hung from their hang tabs 24 in a vertical orientation, the lettering or other indicia (not shown) on label 42 should be parallel to the floor for optimal readability. Moreover, when this label orientation is used for nested packaged assemblies 40 displayed horizontally, alignment of all the hang tabs 24 so that they are diametrically opposite the viewer will ensure that the labels are in the proper orientation for reading.

Preferably, hang tab 24 is sufficiently wide to allow the attachment of labels (not shown) thereon as well. Labels (not shown) affixed to hang tab 24 may be similarly aligned for proper readability.

Figure 8:
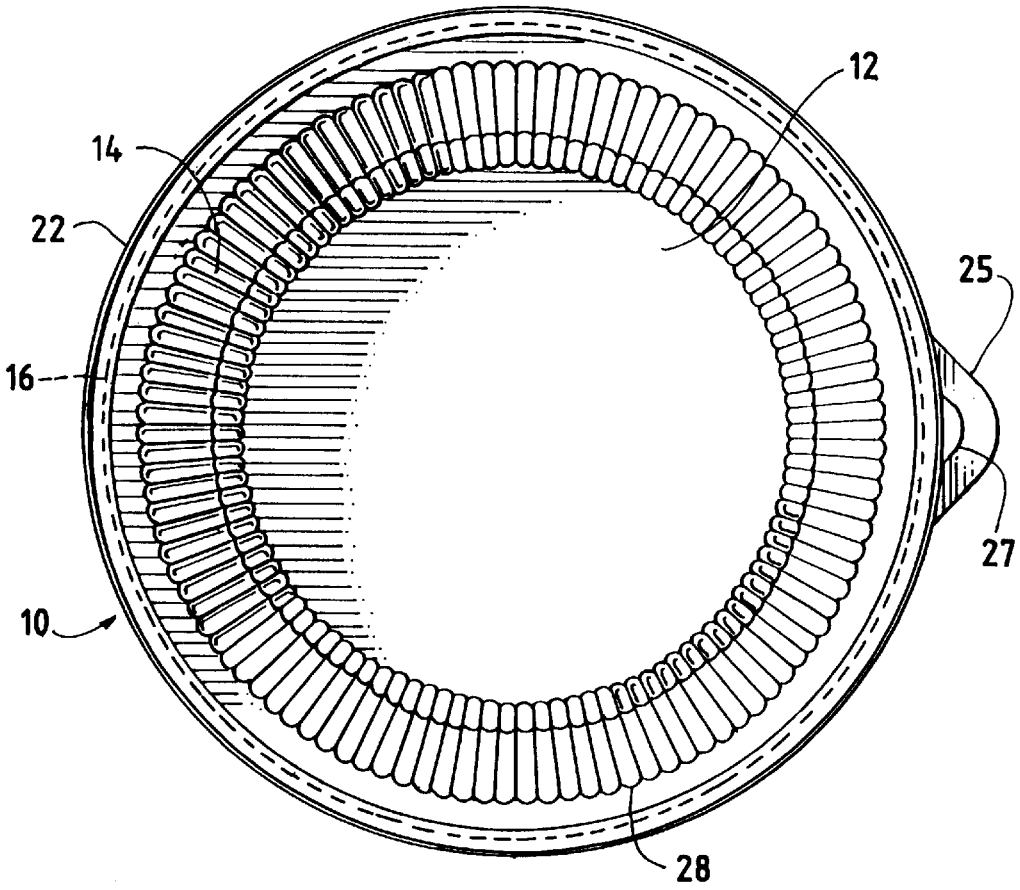
FIG. 8 is a top view of an alternate embodiment of a tray for packaging round foil pans, wherein the tray includes ribbed surfaces on its side and its bottom.
Figure 9:
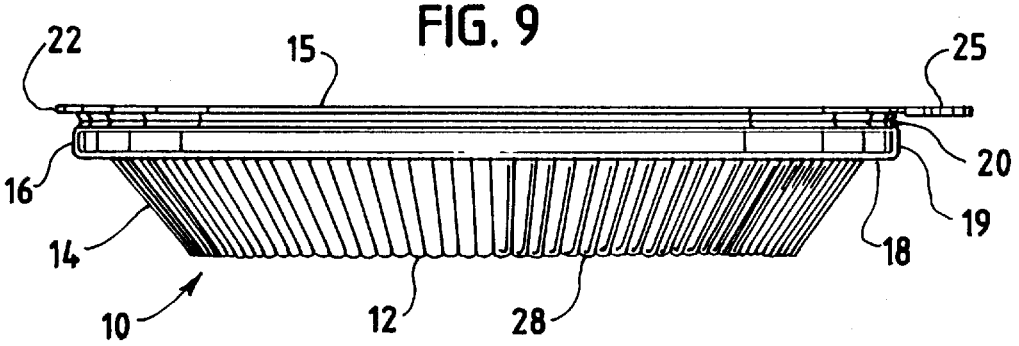
FIG. 9 is a side view of the alternate embodiment shown in FIG. 8 in accordance with the present invention.

FIGS. 8 and 9 show an alternate embodiment of tray 10, wherein the bottom portion 12 and side portion 14 include a plurality of ribs 28. The ribs 28 add strength to bottom portion 12 and side portion 14 of tray 10. By increasing the distance between the packaged foil pans 30 and the outer surface of tray 10, ribs 28 also enhance the ability of tray 10 to cushion the packaged foil pans 30 from impacts. In this way, ribs 28 further protect foil pans 30 from damage. However, even with the addition of ribs 28, bottom portion 12 and side portion 14 still substantially conform to the shape and dimensions of bottom 36 and side 38 of the foil pans 30 so that the packaged assemblies 40 may be nested together. In the embodiment of FIGS. 8 and 9, the integral hang tab is in the form of loop 25. Loop hang tab 25 further defines opening 27, which may engage a hook, bar, or the like to display tray 10 in a vertical orientation.

Figure 4:
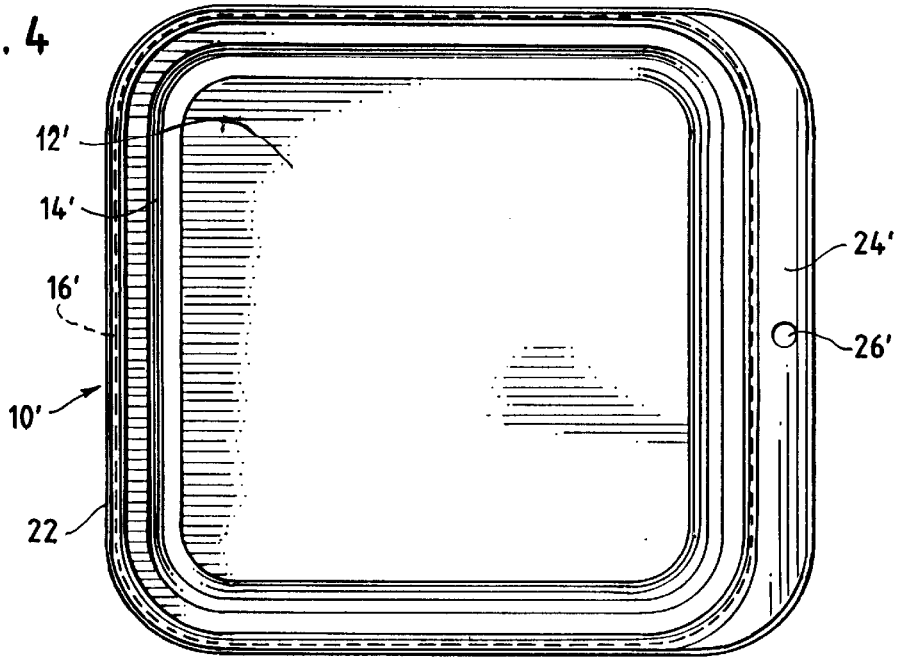
FIG. 4 is a top view of a preferred embodiment of a tray for packaging square foil pans in accordance with the present invention.
Figure 5:
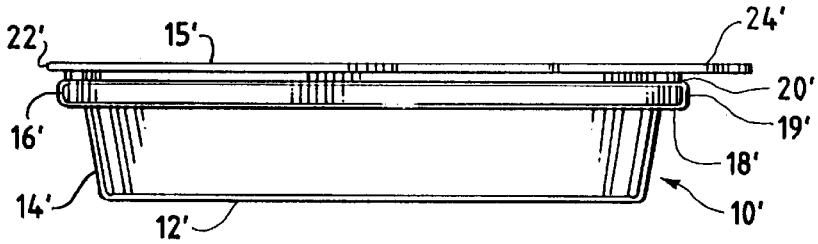
FIG. 5 is a side view of the FIG. 4 embodiment of a tray for packaging square foil pans in accordance with the present invention.

FIGS. 4 and 5 illustrate another embodiment of tray 10' for packaging square foil pans 30'. Tray 10' is substantially similar to tray 10 except that tray 10' has been adapted to package square foil pans 30' rather than round foil pans 30. The features labeled with primed numerals in FIGS. 4 and 5 correspond to the features labeled with the unprimed numerals in FIGS. 1 and 2.

Figure 6:
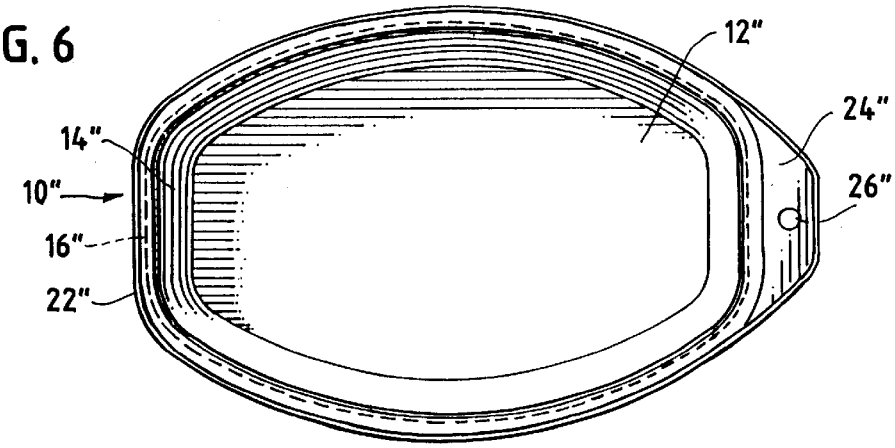
FIG. 6 is a top view of a preferred embodiment of a tray for packaging oval foil pans in accordance with the present invention.
Figure 7:
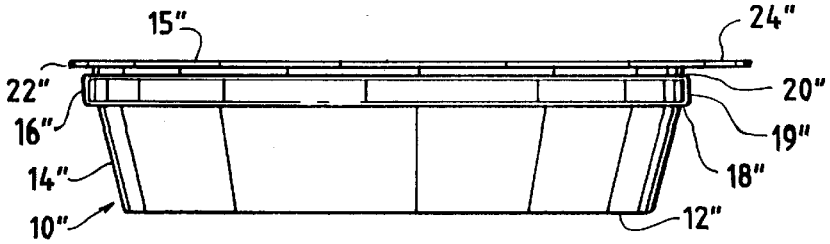
FIG. 7 is a side view of the FIG. 6 embodiment of a tray for packaging oval foil pans in accordance with, the present invention.

Similarly, FIGS. 6 and 7 illustrate another embodiment of tray 10" for packaging oval foil pans 30" that is substantially similar to tray 10 but adapted to package oval instead of round foil pans. The features labeled with double-primed numerals in FIGS. 6 and 7 correspond to the features labeled with unprimed numerals in FIGS. 1 and 2.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims.

What is claimed is:

1. A packaged assembly, comprising:

a predetermined plurality of stacked and nested foil pans having a bottommost and an uppermost foil pan, each said foil pan being substantially identical to the others thereof and each said foil pan having a pan bottom, a pan side, and an outwardly-extending pan flange portion ending in a circumferential pan rim; and a packaging tray within which said plurality of pans is fully received with said bottommost foil pan being surrounded by inner bottom and inner side regions of said packaging tray, said packaging tray having:

a tray bottom portion substantially conforming in dimensions and shape to said pan bottom;

a tray side portion peripherally attached to said tray bottom portion and substantially conforming in dimensions and shape to said pan side; and a tray engagement portion extending peripherally outwardly and upwardly from said tray side portion, said engagement portion having a lower region extending outwardly from said tray side portion and an upper region extending upwardly from said lower region, said upper region having an upper periphery, said periphery having an attached inward protrusion whose width slightly overlies said pan flange of said uppermost one of said plurality of pans and whose length extends circumferentially to overlie the entire circumferential pan rim, whereby said plurality of foil pans is releasably snap locked in said packaging tray between said lower region and said inward protrusion.

2. The packaged assembly of claim 1, further comprising a hang tab attached to said packaging tray.

3. The packaged assembly of claim 2, wherein said hang tab is integral to said packaging tray.

4. The packaged assembly of claim 3, further comprising a label affixed to the uppermost one of said plurality of foil pans using said hang tab as a fixed reference point, whereby said label is properly oriented with respect to said hang tab for optimal readability whether the packaged assembly is displayed horizontally or vertically.

5. The packaged assembly of claim 1, further comprising an outer lip extending from said upper portion of said engagement portion of said packaging tray.

6. The packaged assembly of claim 5, further comprising a hang tab attached to said outer lip.

7. The packaged assembly of claim 6, wherein said hang tab is integral to said outer lip.

8. The packaged assembly of claim 1, wherein said packaging tray includes a ribbed surface.

9. The packaged assembly of claim 1, wherein said packaging tray is made out of plastic.

10. The packaged assembly of claim 9, wherein said plastic is biaxially oriented polystyrene.

* * * * *